US007896452B2

(12) United States Patent
Chang

(10) Patent No.: US 7,896,452 B2
(45) Date of Patent: Mar. 1, 2011

(54) SLIDE BRAKING APPARATUS

(75) Inventor: Kuei-Yun Chang, Taipei County (TW)

(73) Assignee: Nan Juen International Co., Ltd., Taipei County (TW)

( * ) Notice: Subject to any disclaimer, the term of this patent is extended or adjusted under 35 U.S.C. 154(b) by 459 days.

(21) Appl. No.: 12/068,380

(22) Filed: Feb. 6, 2008

(65) Prior Publication Data

US 2009/0195133 A1 Aug. 6, 2009

(51) Int. Cl.
*A47B 88/00* (2006.01)

(52) U.S. Cl. ..... 312/333

(58) Field of Classification Search ..... 312/333, 312/334.44–334.27, 319.1, 334.1, 334.8; 384/20–22

See application file for complete search history.

(56) References Cited

U.S. PATENT DOCUMENTS 6,412,891 B1 * 7/2002 Liang et al. ..... 312/334.44
6,851,774 B2 * 2/2005 Chen et al. ..... 312/334.47
6,945,619 B1 * 9/2005 Chen et al. ..... 312/334.47
7,472,973 B2 * 1/2009 Huang ..... 312/333
2005/0162052 A1 * 7/2005 Chen et al. ..... 312/334.5
2005/0248247 A1 * 11/2005 Huang ..... 312/334.47

* cited by examiner

*Primary Examiner*—Janet M Wilkens
(74) *Attorney, Agent, or Firm*—Muncy, Geissler, Olds & Lowe, PLLC

(57) ABSTRACT

A slide braking apparatus installed on a slide in a cabinet, and the slide sequentially installs a bottom rail, a middle rail and an inner rail. The braking apparatus is disposed between the middle rail and the inner rail. A hook and a control handle for controlling the hook to turn are installed on a surface of the inner rail corresponding to the middle rail. A guide bump is disposed on a surface of the middle rail. The front end of the guide bump has a guide plane for guiding the hook to turn, so that when the hook is turned back to resume its original position, the hook presses precisely at the rear end of the guide bump to limit the inner rail from sliding into the middle rail.

9 Claims, 9 Drawing Sheets

L2
10
12
11
20
21

L1
10'
20'
21'
L2
11
10
12
221
22
21
20
31
30
L3

SLIDE BRAKING APPARATUS

BACKGROUND OF THE INVENTION

1. Field of the Invention

The present invention relates to a slide braking apparatus, and more particularly to a simple linking structure provided for users to control the locking or pushing of a slide in a simple, easy and effort-saving manner.

2. Description of the Related Art

In general, a traditional cabinet for installing computers and related equipments comes with detachable drawers on different decks of the cabinet and a slide disposed between the drawer and the cabinet for guiding the drawer to slide into or out of the cabinet. The structure of the slide sequentially comprises a bottom rail, a middle rail for sliding on the bottom rail, and an inner rail for sliding on the middle rail, wherein the bottom rail is fixed onto an internal side of the cabinet, and the inner rail is installed on a lateral side of the drawer, and the middle rail and the inner rail slide are coupled on a track, such that the drawer can slide into or out of the cabinet successfully.

Although the foregoing slide structure is convenient to operate and maintain, yet its application is not very safe since the slide structure does not have any braking or stopping device, so that the machine on the drawer may slide into the cabinet due to inertia or slide into the cabinet accidentally during maintenance. As a result, strong forces impact the expensive industrial computer and related machines, or even turn the whole cabinet over by the unstable center of gravity of the cabinet.

To solve the aforementioned problem, manufacturers install a locking device on the slide, so that the slide can be locked at an appropriate position to provide a positioning effect, and control the timing of sliding the drawer. A typical structure was disclosed in U.S. Pat. No. 6,817,685 entitled "Release mechanism for drawer slide latches" as shown in FIG. 1, and the mechanism mainly controls a first element 40 to slide into or out of a second element 50, and the structure installs a door latch 41 and a shifting mechanism 42 for controlling the displacement of the door latch 41 at the first element 40 (which is the aforementioned inner rail). When the first element 40 slides a predetermined distance out of the second element 50, the door latch 41 installed on the first element 40 and coupled to a plate 51 of the second element 50 (which is the aforementioned middle rail), such that the first element 40 is locked onto the second element 50 to provide a position limit effect. If it is necessary to slide the first element 40 into the second element 50, the shifting mechanism 42 is pushed to drive the door latch 41 to retract from the plate 51 of the second element 50, so that the first element 40 is pushed into the second element 50.

Although the aforementioned structure can achieve the braking effect to effectively limit the inner rail of its sliding out of the middle rail, yet the application requires further improvements, since the direction of releasing the braking is in the same direction of sliding the first element 40 into the second element 50 in the prior art structure of the shifting mechanism, such that if a user pushes the shifting mechanism 42 to release the braking, the shifting mechanism 42 will push the first element 40 to slide into the second element 50, and the door latch 41 will get stuck in the plate 51 of the second element 50, and the door latch 41 will not be retracted from the plate 51 easily. Further, a friction is used to provide a link between components. In other words, the user must apply a larger moment of force to push the shifting mechanism to release the brake.

In view of the shortcomings of the prior art, the present invention provides a slide braking apparatus to overcome the shortcomings of the conventional braking structure.

SUMMARY OF THE INVENTION

Therefore, it is a primary objective of the present invention to provide a slide braking apparatus installed on two corresponding lateral sides of a middle rail and an inner rail the slide for controlling the timing of sliding the inner rail into the middle rail. The apparatus comprises a guide bump, a hook and a control handle, wherein the hook and the control handle are installed at the inner rail, and the guide bump is disposed on a lateral side of the middle rail, and the hook is elastically and pivotally coupled to a lateral side of the inner rail, and a side of the hook has a rib with a protruded guide bump disposed on an edge of the rib and guided by the front end of the guide bump to drive the hook to turn and press against the rear end of the guide bump, so as to produce a braking effect to the inner rail, and a control handle installed on the inner rail produces a linking effect with the hook by a link element for controlling the hook to turn and separate from the rear end of the guide bump, and successfully push the inner rail into the middle rail. With the linking structural design, users may apply a moment of force from different directions in order to release the action of sliding the inner rail into the middle rail in a convenient and effort-saving manner.

DETAILED DESCRIPTION OF THE PREFERRED EMBODIMENTS

Figure 1:
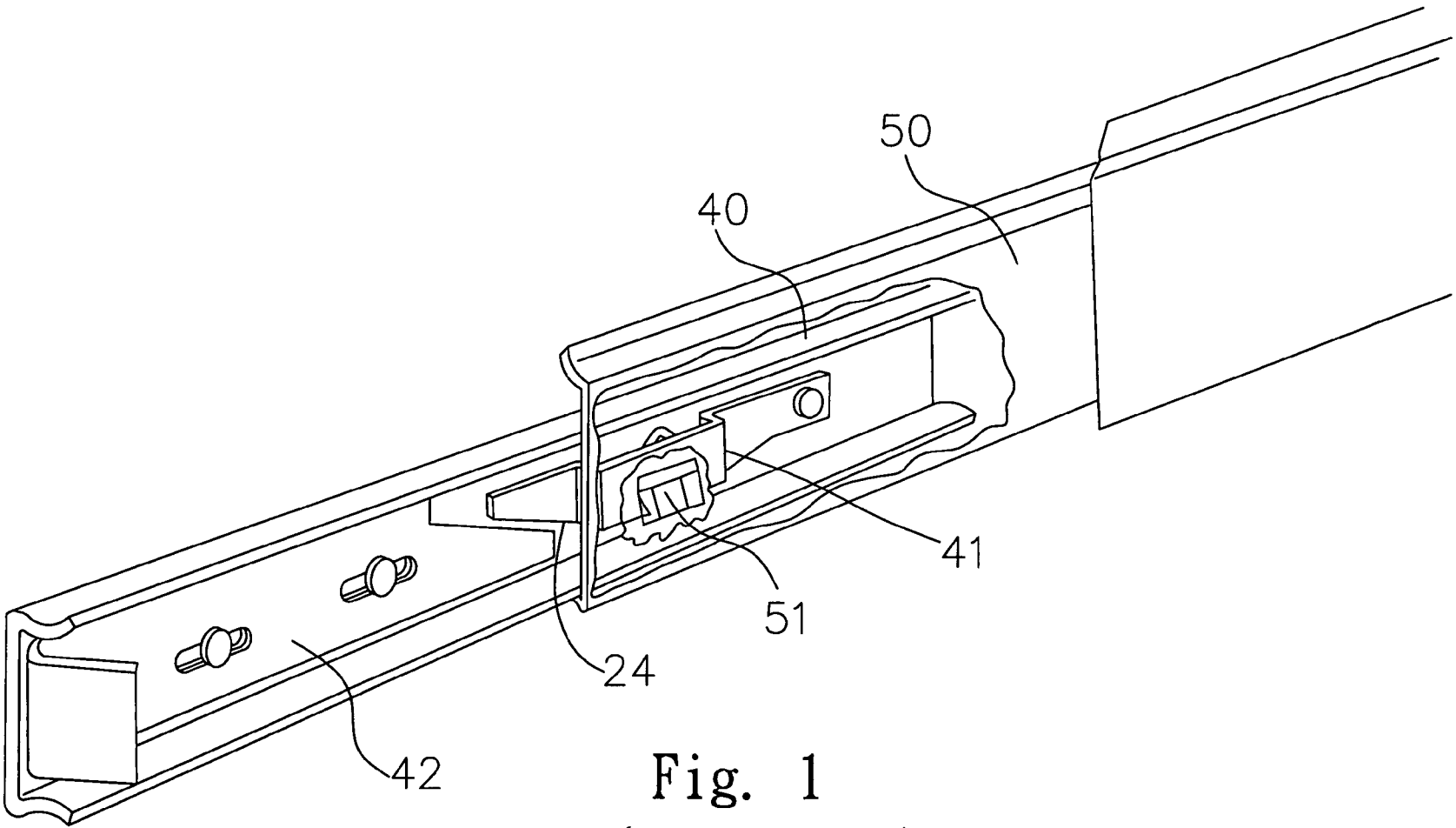
Fig. 1 (Prior Art)
FIG. 1 is a perspective view of a prior art release mechanism.
Figure 2:
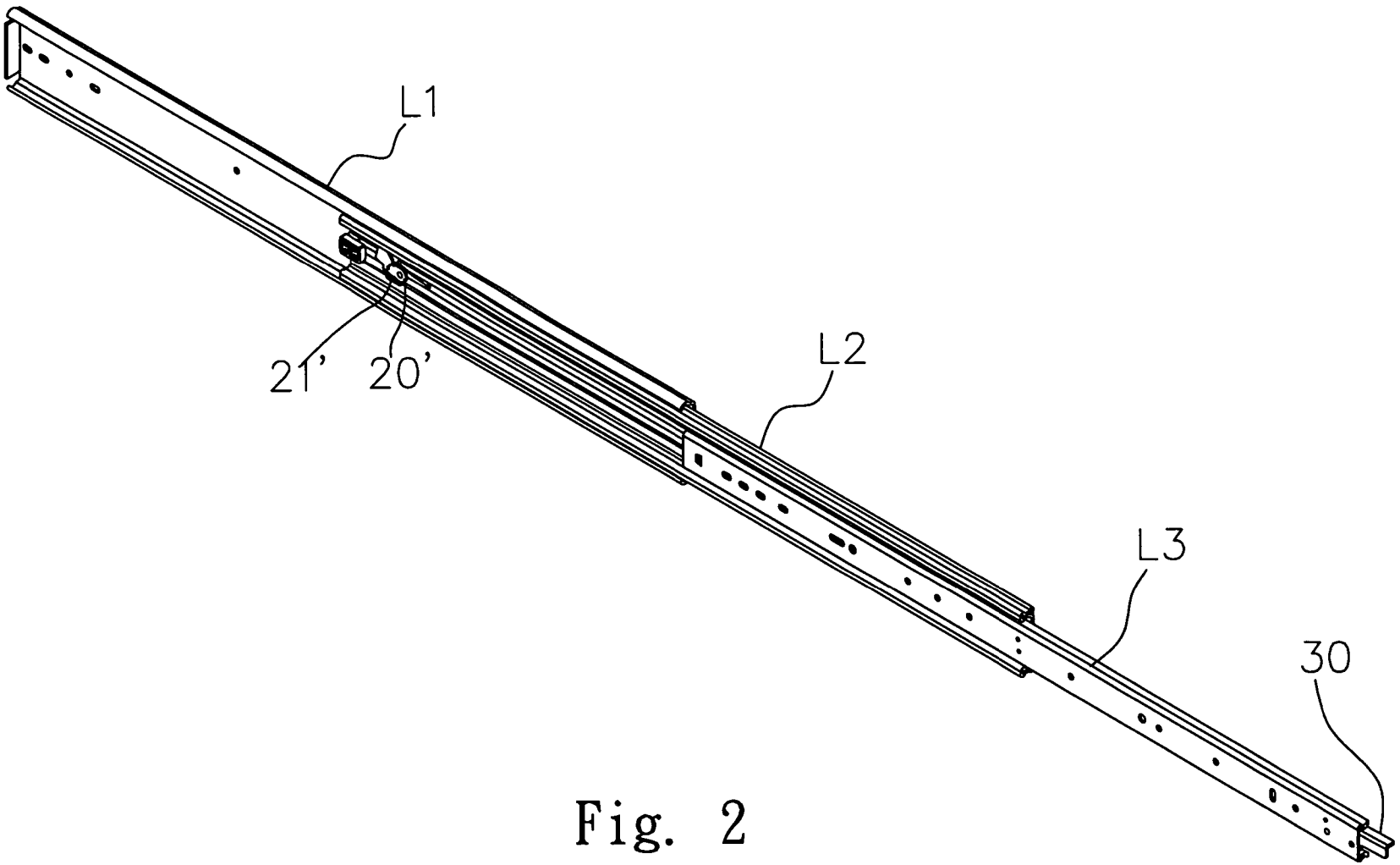
FIG. 2 is a perspective view of a slide of a slide braking apparatus in accordance with the present invention.
Figures 3, 3A:
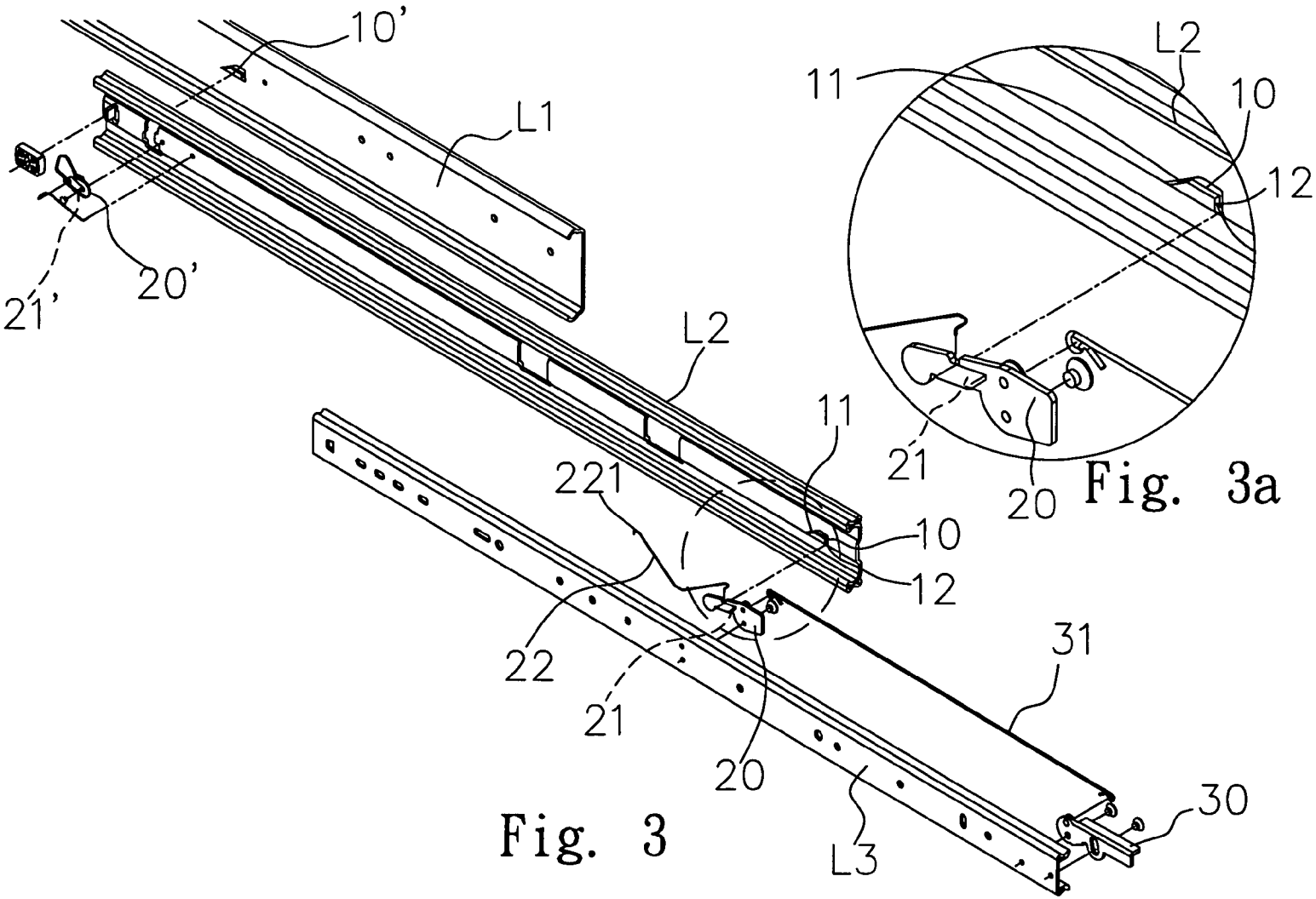
FIG. 3 is an exploded view of a slide braking apparatus in accordance with the present invention.
FIG. 3*a* is an enlarged view of a portion of FIG. 3.
Figure 4:
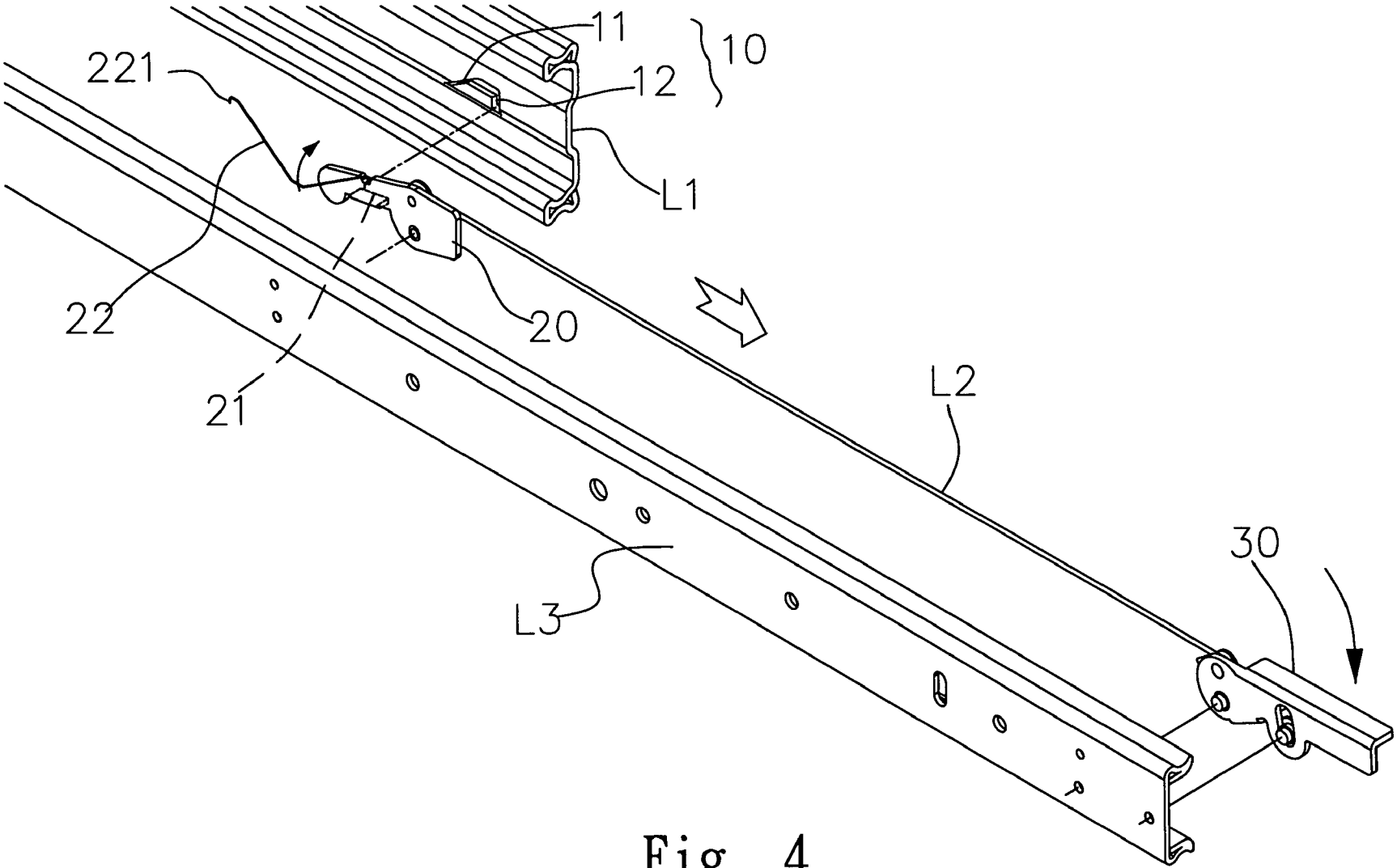
FIG. 4 is an enlarged view of another portion of FIG. 3.

The objective, technical measures and performance of the present invention will become apparent in the detailed description of the preferred embodiments with reference to the accompanying drawings as follows:

Referring to FIGS. 2, 3, 3*a*, and 4, the present invention provides a slide braking apparatus installed between a middle rail L2 and an inner rail L3 for controlling and limiting the timing of sliding the inner rail L3 into the middle rail L2. The braking apparatus comprises a guide bump 10, a hook 20 and a control handle 30, wherein the hook 20 and the control handle 30 are installed on a lateral side of the inner rail L3, and the guide bump 10 is disposed on a lateral side of the middle rail L2 and protruded towards the hook 20.

The front end of the guide bump 10 has a guide plane 11 for guiding the hook 20, and the rear end of the guide bump 10 has a braking plane 12 for pressing against the hook 20.

The hook 20 is pivotally coupled onto a lateral side of the inner rail L3 and elastically turned to an appropriate range on the inner rail L3, and a side of the hook 20 has a resilient element 22, and an end of the resilient element 22 is fixed onto the inner rail L3, and another end of the resilient element 22 is fixed to the hook 20 for supplying a resilience to the hook 20, and the hook 20 has a rib 21 extended perpendicularly towards the middle rail L2, and the rear end of the rib 21 corresponds to the guide plane 11 at the front end of the guide bump 10, and the front end of the rib 21 is provided for pressing against the braking plane 12 at the front end of the guide bump 10.

Similar to the hook 20, the control handle 30 is pivotally coupled to the same side of the inner rail L3 and elastically turned to an appropriate range on the inner rail L3, and the front end of the control handle 30 has a link element 31, and another end of the link element 31 is coupled to the hook 20, so that the control handle 30 links with the hook 20 to turn and control the hook 20 to retract from the braking plane 12 at an appropriate time, so as to release the braking effect of the inner rail L3.

Figure 5:
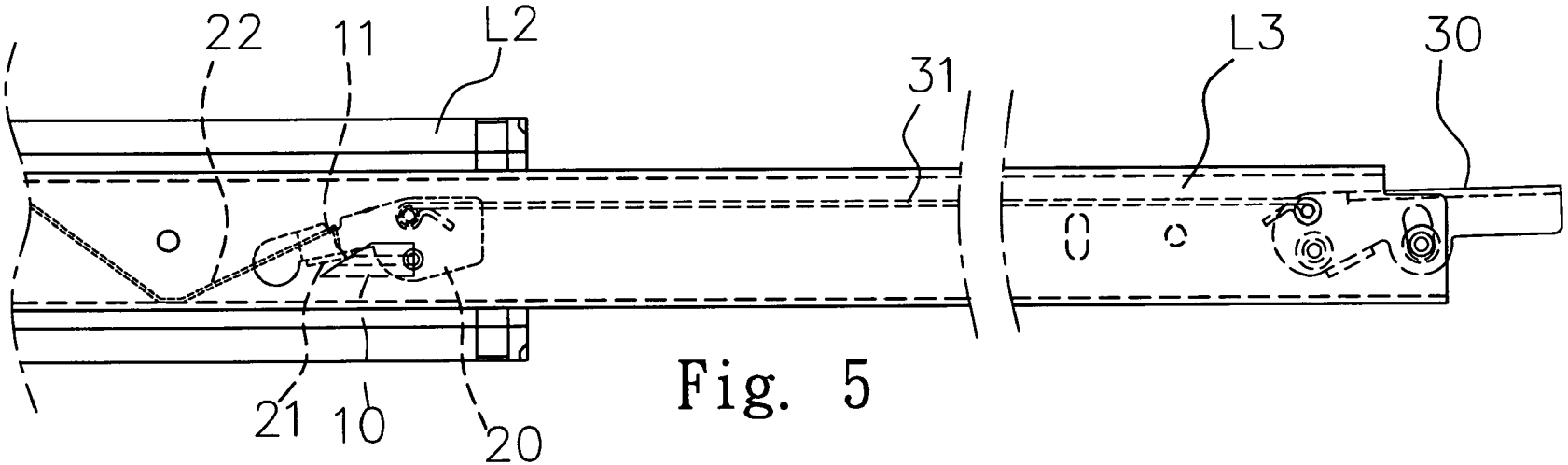
FIG. 5 is a schematic view of the structure of a slide braking apparatus in accordance of the present invention, showing that a hook and a control handle are in a natural status.
Figure 5A:
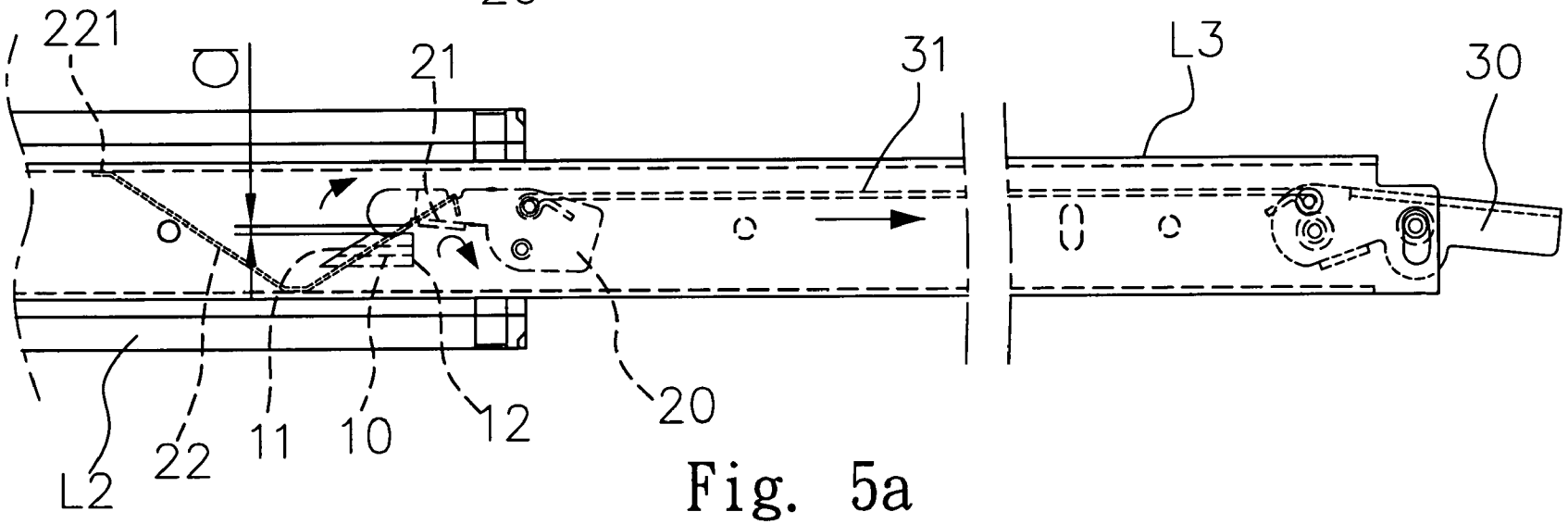
FIG. 5*a* is a schematic view of the structure of a slide braking apparatus in accordance with the present invention, showing that a rib of a hook is in contact with the guide bump and its status of being guided by the guide bump.

Referring to FIGS. 5 and 5*a* for the application, if the inner rail L3 slides an appropriate distance from the middle rail L2, the rib 21 on the hook 20 is contacted with the guide plane 11 at the front end of the guide bump 10 and guided to link with the hook 20 in order to turn the hook 20. When the rib 21 is shifted to an end point of the guide plane 11, the hook 20 resumes its original position by the resilience, such that the front end of the rib 21 is pressed against the braking plane 12 at the rear end of the guide bump 10 to limit the inner rail L3 from sliding into the middle rail L2.

Figure 6:
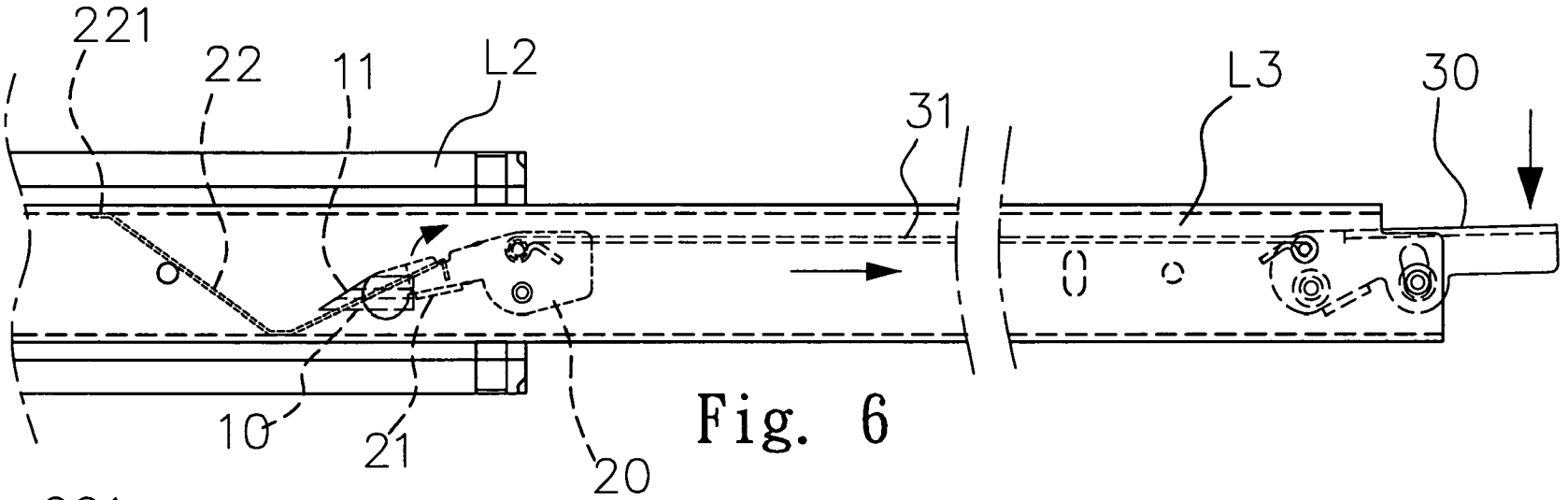
FIG. 6 is a schematic view of the structure of a slide braking apparatus in accordance with the present invention, showing that a control handle links with a hook to turn and its status of being exerted by a force.
Figure 6A:
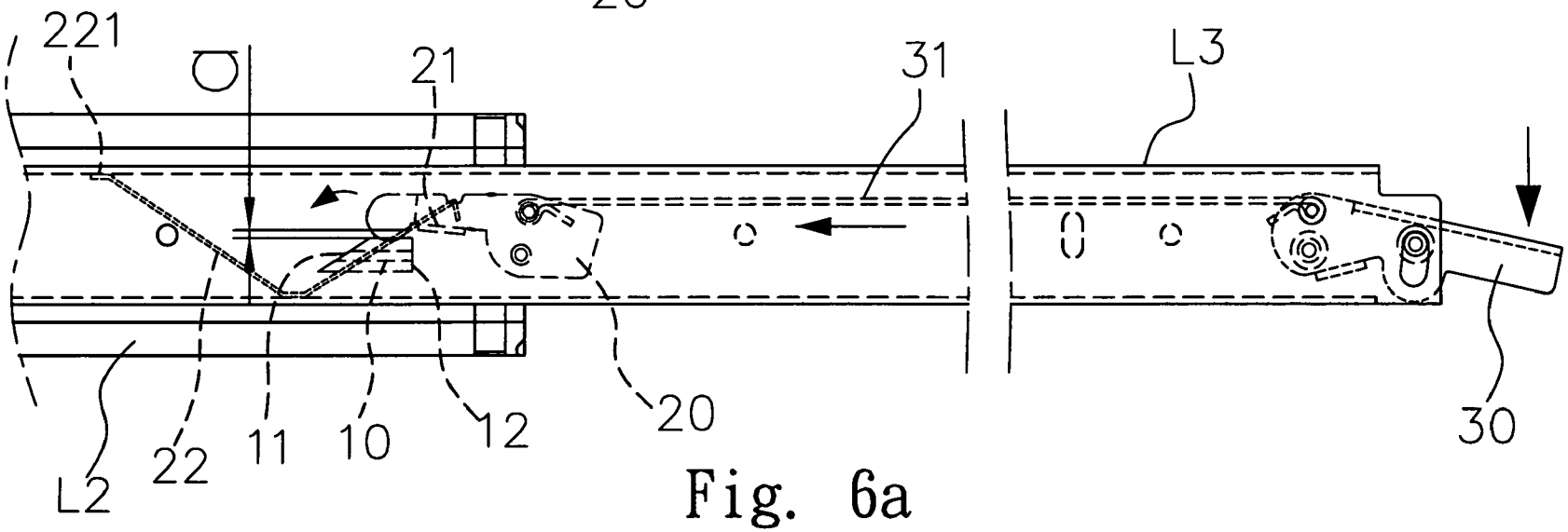
FIG. 6*a* a schematic view of the structure of a slide braking apparatus in accordance with the present invention, showing that a control handle links with a hook to turn and its status of releasing an inner rail from being braked.

In FIGS. 6 and 6*a*, if it is necessary to push the inner rail L3 into the middle rail L2, a downward force is applied onto the control handle 30 to turn the control handle 30 and the link element 31 links with the hook 20 to retract the rib 21 from the braking plane 12, so as to release the braking of the inner rail L3, and push the inner rail L3 into the middle rail L2 successfully.

Figures 7, 7A:
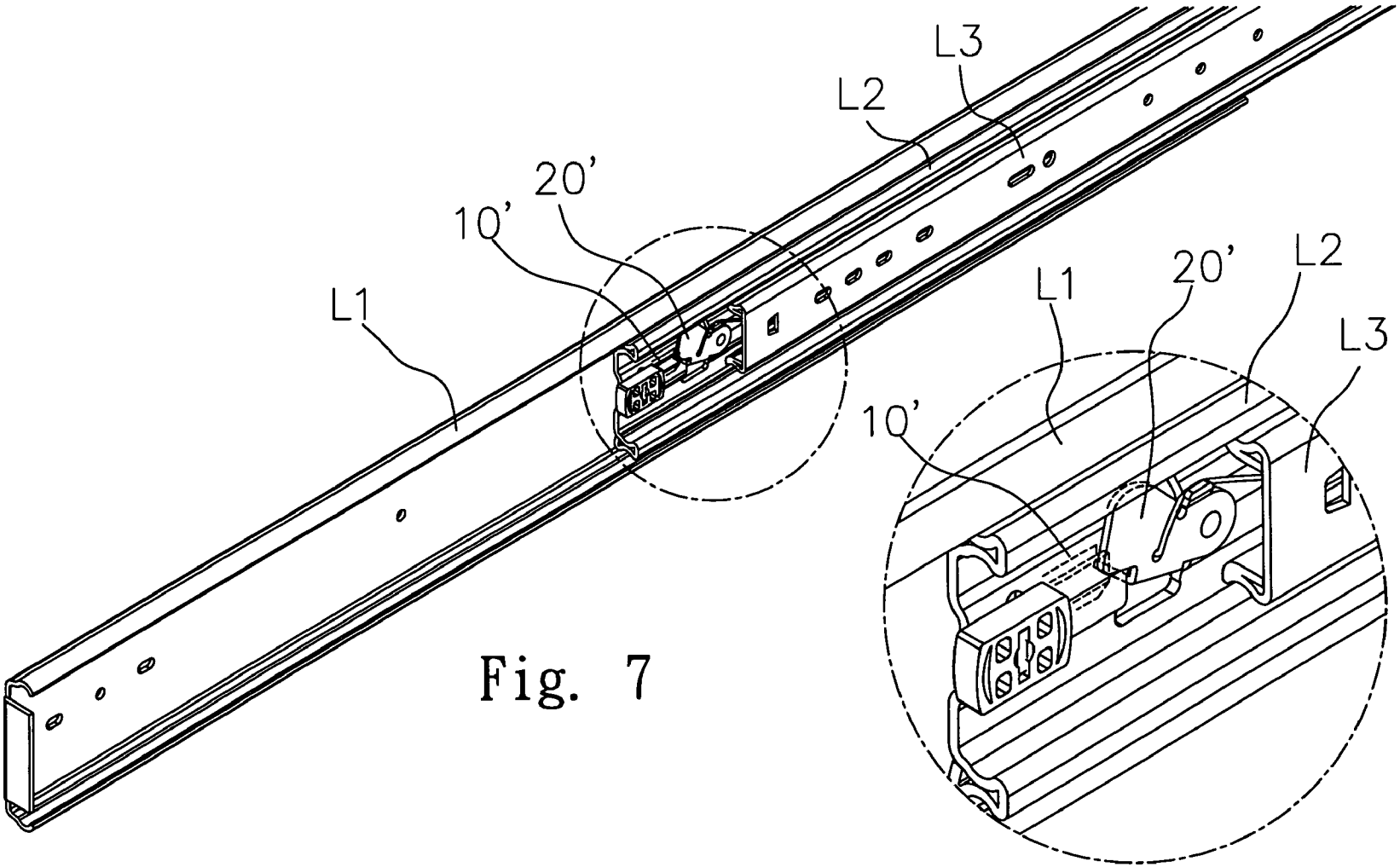
FIG. 7 is a perspective view of an auxiliary slide braking apparatus of a slide braking apparatus in accordance with the present invention.
FIG. 7*a* is an enlarged view of a portion of FIG. 7.
Figure 7B:
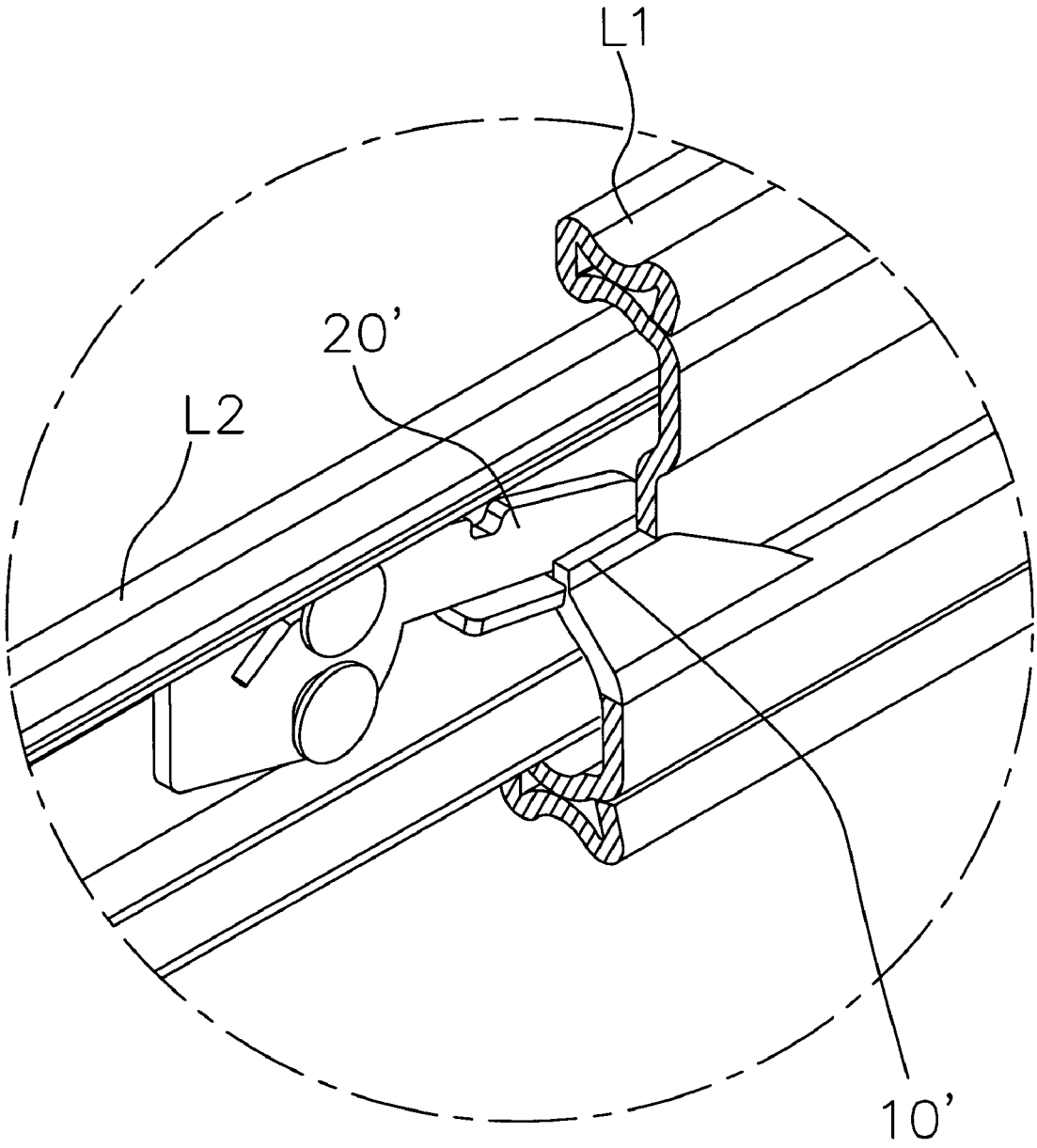
FIG. 7*b* is an enlarged view of a portion of FIG. 7 viewing from another angle.

In FIGS. 7, 7*a* and 7*b*, the present invention further installs an auxiliary braking apparatus between the middle rail L2 and the bottom rail L1 to assist the aforementioned braking apparatus, and the auxiliary braking apparatus is substantially the same as the braking apparatus and comprises an auxiliary guide bump 10' disposed at the bottom rail L1 and an auxiliary hook 20' pivotally coupled to the front end of the middle rail L2, wherein the assembly of the auxiliary guide bump 10' and the auxiliary hook 20' are the same as the guide bump 10 and the hook 20, and thus will not be described here.

Figure 8:
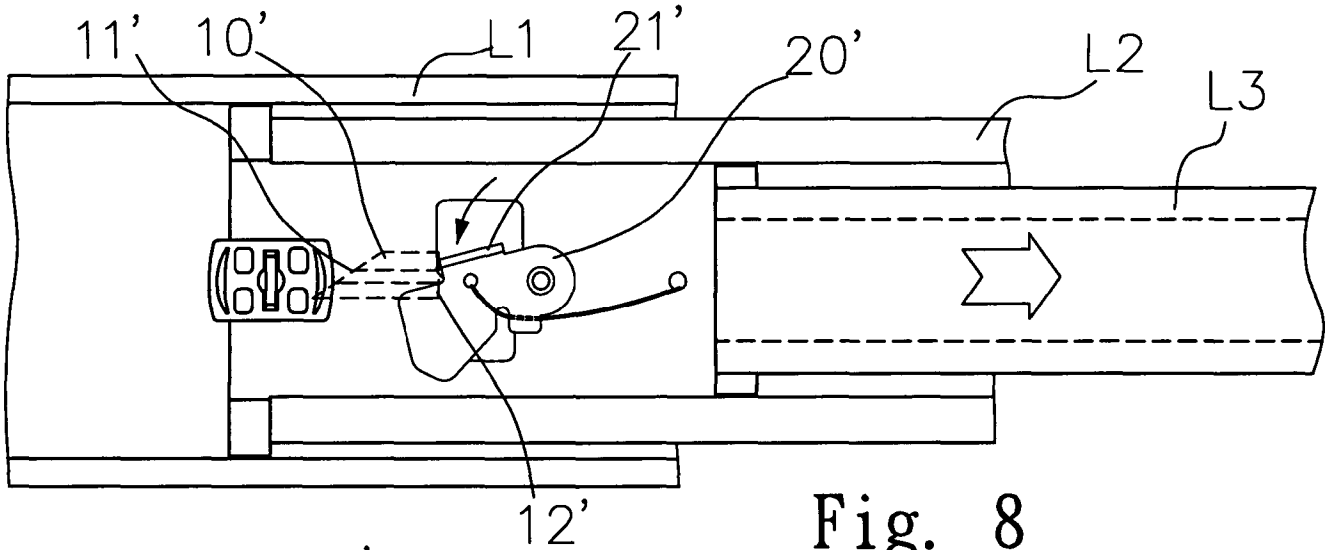
FIG. 8 is a schematic view of the structure of a slide braking apparatus in accordance with the present invention, showing that a rib presses against a braking plane.

Referring to FIG. 8 for the application, if the inner rail L3 slides out and link with the middle rail L2 to side the bottom rail L1 out, the rib 21' of the auxiliary hook 20' installed on the middle rail L2 is guided by the guide plane 11' at the front end of the auxiliary guide bump 10' of the bottom rail L1 to link and turn the auxiliary hook 20'. If the rib 21' of the auxiliary hook 20' is shifted to the end point of the guide plane 11', the auxiliary hook 20' will resume its original position by resilience, so that the rib 21' presses the braking plane 12' at the rear end of the auxiliary guide bump 10' to brake the middle rail L2 (as shown in FIG. 8).

Figure 9:
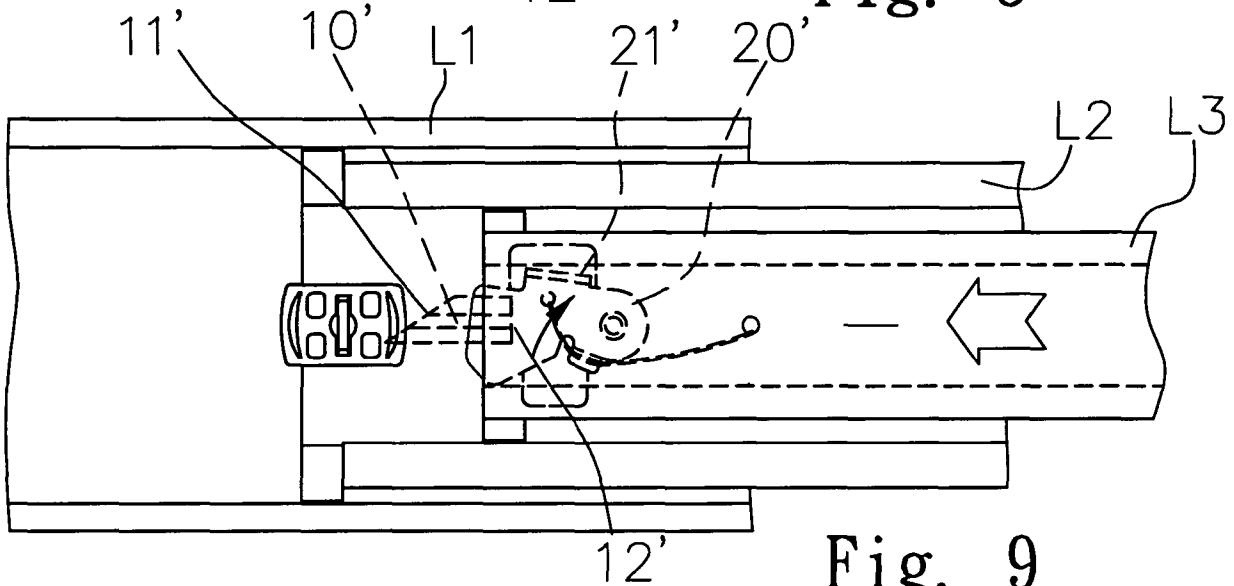
FIG. 9 is a perspective view of a slide braking apparatus in accordance with another preferred embodiment of the present invention, showing that an auxiliary hook is turned by a force from the inner rail to retract a rib from a braking plane.

In FIG. 9, if it is necessary to push the middle rail L2 into the bottom rail L1, the method of releasing the braking apparatus installed between the middle rail L2 and the inner rail L3 can be used, wherein a force is applied to the control handle 30 (not shown in the figure) to release the braking effect of the inner rail L3, such that when the inner rail L3 slides into the middle rail L2, the rear end of the inner rail L3 is pressed against an end of the auxiliary hook 20' to turn the auxiliary hook 20', and the rib 21 is retracted from the braking plane 12' (as shown in FIG. 9) to release the braking effect of the middle rail L2 and push the middle rail L2 into the bottom rail L1 successfully.

While the invention has been described by means of specific embodiments, numerous modifications and variations could be made by those skilled in the art without departing from the scope and spirit of the invention set forth in the claims.

What is claimed is:

1. A slide braking apparatus installed on a slide, comprising:

a guide bump, installed on a lateral side of a middle rail of said slide, and protruded towards an inner rail of said slide;

a hook, pivotally coupled to a lateral side of said inner rail, and corresponding to said guide bump, for elastically turning within a range, and said hook being guided by the front end of said guide bump to turn and prop at the rear end of said guide bump; and, a control handle, pivotally coupled to said inner rail, for elastically turning within a range, and said control handle is coupled to a link element linking said hook to turn and retract from the rear end of said guide bump.

2. The slide braking apparatus installed on a slide according to claim 1, wherein said hook comprises a resilient element installed at an end of the hook, and an end of said resilient element is fixed onto said inner rail, for supplying resilience to said hook to elastically turn said hook within a range.

3. The slide braking apparatus installed on a slide according to claim 1, wherein an end of said link element is installed at the front end of said control handle, and another end of said link element is coupled to said hook.

4. The slide braking apparatus installed on a slide according to claim 1, wherein said hook further comprises a rib extended and protruded towards said middle rail, such that the rear end of said rib is guided by the front end of said guide bump to turn and press against the rear end of said guide bump.

5. The slide braking apparatus installed on a slide according to claim 4, wherein said rib is perpendicular to a surface of said hook.

6. The slide braking apparatus installed on a slide according to claim 1, wherein slide braking apparatus further including an auxiliary slide braking apparatus installed between said middle rail and a bottom rail, comprises:

an auxiliary guide bump, disposed on a lateral side of said bottom rail, and protruded towards said middle rail; and an auxiliary hook, pivotally coupled to a side of said middle rail corresponding to said bottom rail, for flexibly turning within a range, and said auxiliary hook is guided by the front end of said auxiliary guide bump to turn and press against the rear end of said auxiliary guide bump.

7. The slide braking apparatus installed on a slide according to claim 6, wherein said auxiliary hook comprises a resilient element installed at an end of said auxiliary hook, and an end of said resilient element is fixed onto said middle rail, for providing resilience to said auxiliary hook to elastically turn said auxiliary hook within a range.

8. The slide braking apparatus installed on a slide according to claim 6, wherein said auxiliary hook comprises a rib extended from a lateral side corresponding to said bottom rail.

9. The slide braking apparatus installed on a slide according to claim 8, wherein said rib is perpendicular to a surface of said resilient element.

* * * * *